United States Patent [19]

Pahade et al.

[11] Patent Number: 4,957,524

[45] Date of Patent: Sep. 18, 1990

[54] AIR SEPARATION PROCESS WITH IMPROVED REBOILER LIQUID CLEANING CIRCUIT

[75] Inventors: Ravindra F. Pahade, Getzville; John H. Ziemer, Grand Island; John K. Howell, Tonawanda, all of N.Y.

[73] Assignee: Union Carbide Corporation, Danbury, Conn.

[21] Appl. No.: 351,807

[22] Filed: May 15, 1989

[51] Int. Cl.[5] ..... F25J 3/02

[52] U.S. Cl. ..... 62/18; 62/44

[58] Field of Search ..... 62/17, 18, 9, 11, 32, 62/36, 42, 44

[56] References Cited

U.S. PATENT DOCUMENTS

| | | | |
|---|---|---|---|
| 2,650,482 | 9/1953 | Lobo | 62/175.5 |
| 2,889,686 | 6/1959 | Kohler | 62/6 |
| 2,939,404 | 6/1960 | Schilling | 103/232 |
| 3,339,370 | 9/1957 | Streich et al. | 62/18 |
| 3,426,543 | 2/1969 | Becker | 62/18 |
| 3,630,640 | 12/1971 | McMurry et al. | 417/54 |
| 3,735,599 | 5/1973 | Izumichi et al. | 62/18 |
| 4,222,756 | 9/1980 | Thorogood | 62/13 |
| 4,337,070 | 6/1982 | Rohde | 62/18 |
| 4,400,188 | 8/1983 | Patel et al. | 62/13 |
| 4,439,220 | 3/1984 | Olszewski et al. | 62/31 |
| 4,448,595 | 5/1984 | Cheung | 62/31 |
| 4,453,957 | 6/1984 | Pahade et al. | 62/25 |
| 4,543,115 | 9/1985 | Agrawal et al. | 62/25 |
| 4,662,916 | 5/1987 | Agrawal et al. | 62/13 |
| 4,662,917 | 5/1987 | Cormier et al. | 62/13 |
| 4,662,918 | 5/1987 | Agrawal et al. | 62/13 |
| 4,717,410 | 1/1988 | Grenier | 62/29 |

OTHER PUBLICATIONS

Oxygen: 2000 Tons/Day, Shaner and Sweeney, Mechanical Engineering, Jan. 1978, pp. 38–42.

*Primary Examiner*—Ronald C. Capossela
*Attorney, Agent, or Firm*—Stanley Ktorides

[57] ABSTRACT

A cryogenic rectification method wherein liquid from a top condenser-reboiler is cleaned of higher boiling impurities by passage through an adsorbent bed and returned to the condenser-reboiler, wherein the flow back to the condenser-reboiler is driven by combination with density-reducing vapor.

13 Claims, 2 Drawing Sheets

AIR SEPARATION PROCESS WITH IMPROVED REBOILER LIQUID CLEANING CIRCUIT

TECHNICAL FIELD

This invention relates generally to cryogenic air separation and more particularly, to cryogenic air separation employing multiple condenser-reboilers.

BACKGROUND ART

Feed air to a cryogenic air separation plant is precleaned of higher boiling impurities such as carbon dioxide, water vapor and hydrocarbons prior to passage of the feed air to the distillation column or columns. This precleaning is generally done by passing the feed air through molecular sieve prepurifiers or through reversing heat exchangers followed by gel traps. This precleaning results in a feed air stream having very low concentrations of higher boiling impurities.

Over time, however, some hydrocarbons will accumulate in the oxygen-enriched liquid produced in the rectification column(s). This is because, of the three major components of air, nitrogen, argon and oxygen, oxygen has the lowest volatility and thus these higher boiling impurities will go with the oxygen. Moreover as the oxygen-enriched liquid is reboiled, the higher boiling impurities will preferentially remain in the liquid rather than be boiled off. Such an increasing concentration of hydrocarbons in liquid oxygen poses a safety problem.

Those skilled in the art have addressed this problem by passing oxygen-enriched liquid from a reboiler through an adsorbent bed to remove the hydrocarbons from the liquid. The liquid is pumped from the reboiler and through the adsorbent bed by a liquid pump. A conventional liquid pumped adsorbent bed is illustrated in "Oxygen: 2000 Tons/Day", Mechanical Engineering, January, 1978, R. L. Shaner and W. E. Sweeney.

While this system for cleaning reboiler liquid of higher boiling impurities has been satisfactory, it does have some disadvantages. For example, the use of a pump, as with any piece of rotating equipment, introduces some unreliability and potential hazard to the cryogenic air separation process because of the potential for failure of the moving parts. In addition, the pump uses energy and introduces heat input into the cryogenic process requiring a corresponding increase in refrigeration generation resulting in a process inefficiency.

Accordingly it is an object of this invention to provide an improved method for the cryogenic separation of air wherein oxygen-enriched reboiler liquid is cleaned of higher boiling impurities without need for a liquid pump.

SUMMARY OF THE INVENTION

The above and other objects which will become apparent to one skilled in the art upon a reading of this disclosure are attained by this invention which is:

A method for cryogenic separation comprising:

(A) separating a feed comprising nitrogen, oxygen and higher boiling impurities, in a column having a top condenser-reboiler, into nitrogen-richer vapor and oxygen-enriched liquid containing higher boiling impurities;

(B) passing oxygen-enriched liquid from the column to the top condenser-reboiler;

(C) passing oxygen-enriched liquid from the top condenser-reboiler through an adsorbent bed, transferring higher boiling impurities from the liquid to the adsorbent, and returning resulting cleaned liquid to the top condenser-reboiler; and (D) driving the liquid back to the top condenser-reboiler, at least in part, by combining the liquid with vapor to reduce the density of the stream passing back to the top condenser-reboiler.

As used herein, the term "adsorbent bed" means a contacting device or zone in which a fluid phase mixture is contacted with a rigid and durable particulate phase. The particulate phase or adsorbent has the property of selectively taking up and storing some of the solute species from the fluid. For a further discussion of adsorption see the Chemical Engineers' Handbook, Fifth Edition, edited by R. H. Perry and C. H. Chilton, McGraw Hill Book Company, New York, Section 16, "Adsorption and Ion Exchange".

The term, "column", as used herein means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For a further discussion of distillation columns see the Chemical Engineers' Handbook, Fifth Edition, edited by R. H. Perry and C. H. Chilton, McGraw-Hill Book Company, New York, Section 13, "Distillation" B. D. Smith et al, page 13-3 *The Continuous Distillation Process.* The term, "double column" is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

As used herein, the term "equilibrium stage" means a vapor-liquid contacting stage whereby the vapor and liquid leaving that stage are in mass transfer equilibrium. For a separation column that uses trays or plates, i.e. separate and discrete contacting stages for the liquid and gas phases, an equilibrium stage would correspond to a theoretical tray or plate. For a separation column that uses packing, i.e. continuous contacting of the liquid and gas phases, an equilibrium stage would correspond to that height of column packing equivalent to one theoretical plate. An actual contacting stage, i.e. trays, plates, or packing, would have a correspondence to an equilibrium stage dependent on its mass transfer efficiency.

The term "indirect heat exchange", as used herein means the bringing of two fluid streams into heat exchange relation without any physical contact or intermixing of the fluids with each other.

As used herein the term "condenser-reboiler" means an indirect heat exchange device or zone in which vapor is condensed against boiling liquid. A further discussion of condenser-reboilers appear in Ruheman, "The Separation Of Gases" Oxford University Press, 1949, Chapter VII, Commercial Air Separation.

DETAILED DESCRIPTION

The invention is particularly advantageous in an air separation process employing multiple condenser-reboilers such as is described in U.S. Pat. No. 4,453,957-Pahade et al. In such processes kettle liquid flash is available to provide some or all of the driving force. This reduces the amount of vapor addition which may be required. Also in such processes there is available a kettle vapor stream with enriched oxygen content at sufficient pressure to be used directly as vapor addition. A multiple condenser-reboiler double column air separation process is illustrated in FIG. 1 and the invention will be described in detail with reference to FIG. 1.

Figure 1:
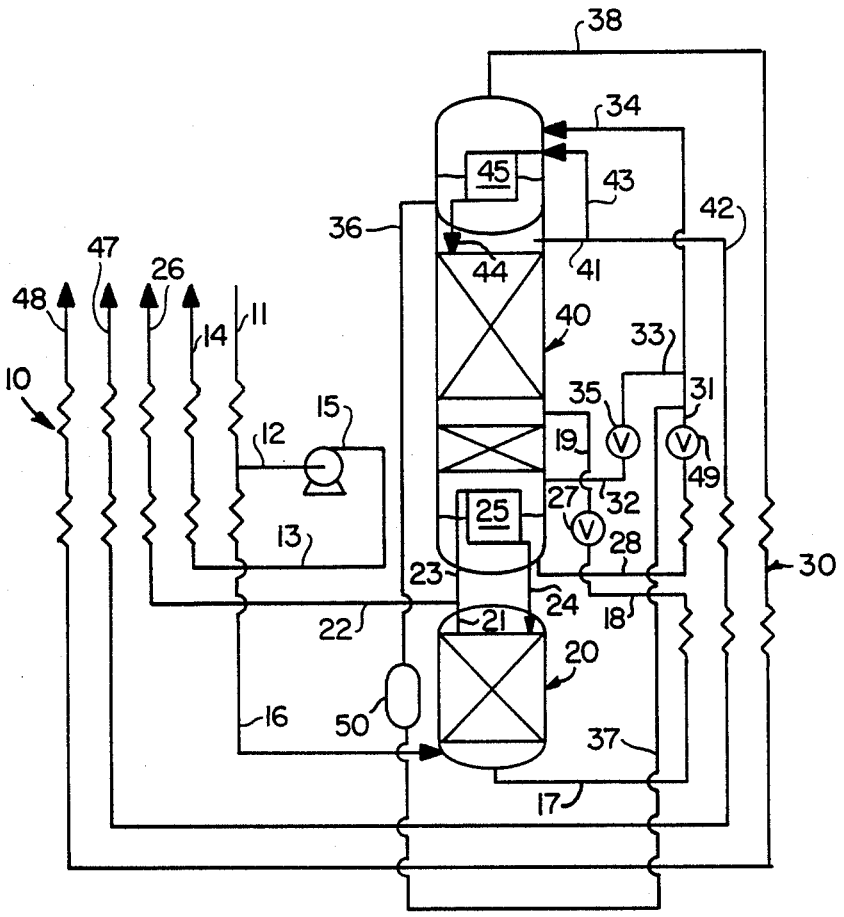
FIG. 1 is a schematic flow diagram of one embodiment of the invention wherein the separation is carried out with a double column and multiple condenser-reboilers.

Referring now to FIG. 1, pressurized, precleaned feed air 11 is cooled by passage through heat exchanger 10 by indirect heat exchange with return streams. A portion 12 of the feed air is expanded through expander 15 to generate refrigeration and the expanded stream 13 is passed out through heat exchanger 10 as stream 14. Resulting cooled feed air 16 is then passed into a cryogenic rectification column or columns for separation. In the embodiment illustrated in the Figure, the cryogenic rectification is carried out in a double column wherein a higher pressure column 20 and a lower pressure column 40 are in heat exchange relation. Other cryogenic rectification arrangements which may be used with this invention include a single column and two or more columns in series.

Column 20 is operating at a pressure generally within the range of from 70 to 240 pounds per square inch absolute (psia). Feed air 16 is separated in column 20 by cryogenic rectification into top-vapor 21 and bottom liquid 17. Top vapor 21 is divided into part 22, which is passed out through heat exchanger 10 and may be recovered as high pressure nitrogen 26, and into part 23 which is passed into bottom condenser-reboiler 25 at the bottom of lower pressure column 40. This bottom condenser-reboiler may be within this column or may be outside the column; however it operates at a pressure substantially the same as that of lower pressure column 40. Part 23 is condensed in condenser-reboiler 25 against reboiling column 40 bottoms to generate vapor upflow for column 40. Resulting condensed stream 24 is returned to column 20 as liquid reflux. Bottom liquid 17 is subcooled by indirect heat exchange with return streams in heat exchanger 30 and the resulting subcooled stream 18 is expanded through valve 27 and passed as stream 19 into lower pressure column 40 which is operating at a pressure below that of column 20 and generally within the range of from 35 to 120 psia. Within column 40 stream 19 is separated by cryogenic rectification into nitrogen-richer vapor and oxygen-enriched liquid containing higher boiling impurities.

Nitrogen-richer vapor 41 is divided into part 42, which is warmed by passage through heat exchangers 30 and 10 and may be recovered as lower pressure nitrogen 47, and into part 43 which is passed into second condenser-reboiler 45. Part 43 is condensed in condenser-reboiler 45 against boiling oxygen-enriched liquid and the resulting condensed stream 44 is passed down column 40 as reflux liquid.

Oxygen-enriched liquid is passed out of column 40 from condenser-reboiler 25 as stream 28 and subcooled by indirect heat exchange through heat exchanger 30, Resulting subcooled stream 29 is expanded through valve 49 and passed 31 into top condenser-reboiler 45. The pressure within top condenser-reboiler 45 is lower than that at which column 40 is operating and generally is within the range of from 12 to 35 psia. The typical operating pressure of top condenser-reboiler 45 is 18 psia. Within condenser-reboiler 45 the oxygen-enriched liquid is boiled by indirect heat exchange with condensing nitrogen-richer vapor, and the resulting oxygen-enriched vapor 38 is warmed by passage through heat exchangers 30 and 10 and passed out as stream 48.

As oxygen-enriched liquid is continuously boiled in top condenser-reboiler 45, the remaining unvaporized liquid becomes progressively richer in higher boiling hydrocarbon impurities. In order to clean the oxygen-enriched liquid of these impurities, a stream 36 of oxygen-enriched liquid is passed out of top condenser-reboiler 45 and through adsorbent bed 50. Adsorbent bed 50 is generally comprised of silica gel as the adsorbent. Other adsorbents suitable for use to clean the oxygen-enriched liquid of higher boiling impurities may include molecular sieves and aluminas. The flowrate through adsorbent bed 50 may be up to 25 percent of feed air stream 16 on a molar basis and most typically is about 10 percent. Cleaned oxygen-enriched stream 37 is then returned to top condenser-reboiler 45 for continued processing.

Liquid is taken from the sump of top condenser-reboiler 45 and flows by static head, i.e. by gravity, through line 36 to lower elevation adsorbent bed 50. The liquid passes through the adsorbent bed for removal of hydrocarbon contaminants. The cleaned liquid then flows through conduit 37 to the down stream side of valve 49. The liquid then passes through conduit 34 back to top condenser-reboiler 45. Liquid from lower level condenser-reboiler 25 flows through conduit 28, is valve expanded through valve 49 and then passes through conduit 34 to top condenser-reboiler 45. The liquid from condenser-reboiler 25 is combined with the recirculating liquid 37.

Condenser-reboiler 25 operates at a higher pressure level then does condenser-reboiler 45. The pressure differential is available to transfer the liquid from the sump of condenser-reboiler 25, through conduit 28, across valve 49, through conduit 34 and into condenser-reboiler 45. Since the liquid in line 28 is saturated and its pressure is reduced by passage through valve 49, some of the liquid flashes and thereby the resulting fluid in conduit 34 is two-phase. Typically, the available pressure differential is sufficient so that the liquid from conduit 37 can be added downstream of valve 49 and the resulting combined liquid and vapor stream can be transported to top condenser-reboiler 45. However, depending on the available pressure differential, the elevation difference between condenser-reboilers 25 and 45, and the quantity of recirculating liquid in conduit 37, it may be necessary to increase the vapor portion of the stream in conduit 34. This can be done by adding some vapor from the bottom or lower portion of column 40 through conduit 32, valve 35 and conduit 33. The net result is that the vapor addition allows the liquid head in conduit 36 to more effectively circulate liquid through adsorbent bed 50. Adding vapor to the condenser-reboiler return stream reduces the stream density. The hydrostatic head difference between the adsorbent bed liquid inlet line 36 and the two-phase portions of the return line 34 provides the required driving force for circulation.

Now by the use of the method of this invention one can separate air by cryogenic rectification and clean oxygen-enriched liquid of higher boiling impurities by passage in contact with adsorbent without the need for a liquid pump. This removes the hazard associated with moving part failure, reduces heat input into the cryogenic process, is less costly than a liquid pump, and reduces power consumption.

Figure 2:
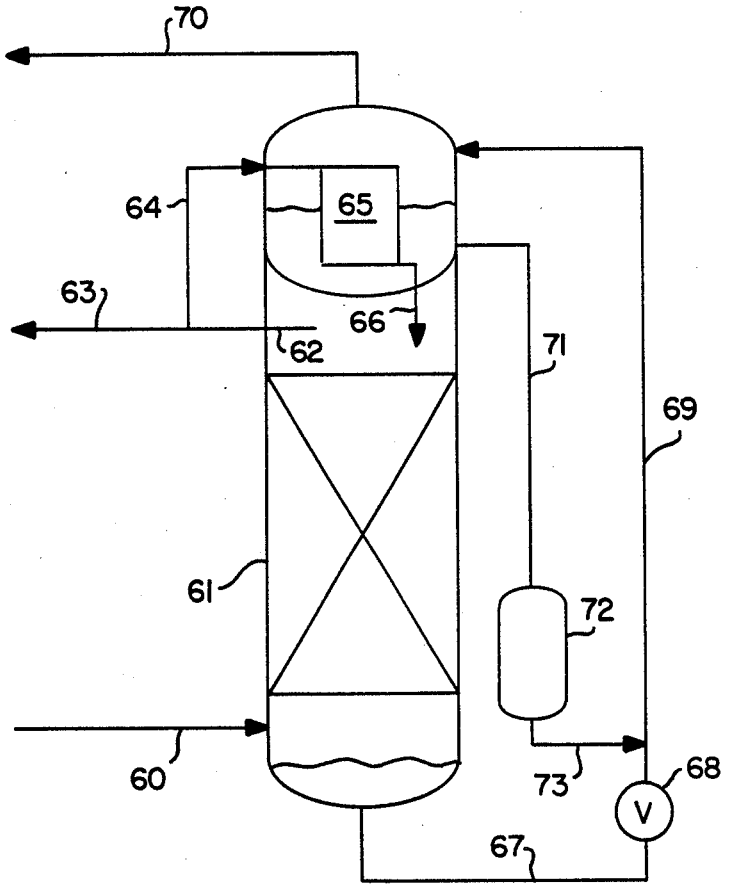
FIG. 2 is a simplified schematic flow diagram of another embodiment of the invention wherein the separation is carried out with a single column.

FIG. 2 illustrates the method of this invention carried out with a single column having a single condenser-reboiler. Referring now to FIG. 2, feed air 60 is passed into column 61 wherein it is separated by cryogenic rectification into nitrogen-richer vapor and oxygen-enriched liquid containing higher boiling impurities. Nitrogen-richer vapor 62 is divided into product 63 and into part 64 which is passed into top condenser-reboiler 65 wherein it is condensed against boiling oxygen-enriched liquid and the resulting condensed stream 66 is passed down column 61 as reflux liquid. Oxygen-enriched liquid is passed out from or near the bottom of column 61 as stream 67, expanded and flashed through valve 68 and passed 69 into top condenser-reboiler 65 which is operating at a pressure less than that at which column 61 is operating. Within top condenser-reboiler 65 the oxygen-enriched liquid is boiled by indirect heat exchange with condensing nitrogen-richer vapor and the resulting vapor 70 is passed out of the system. A stream 71 of oxygen-enriched liquid is passed out of top condenser-reboiler 65 and through adsorbent bed 72. Cleaned oxygen-enriched stream 73 is combined with the partially flashed kettle liquid in stream 69 and returned to top condenser-reboiler 65 for continued processing.

Although the invention has been described in detail with reference to a certain specific embodiments, those skilled in the art will recognize that there are other embodiments of this invention within the spirit and scope of the claims.

We claim:

1. A method for cryogenic separation comprising:

(A) separating a feed comprising nitrogen, oxygen and higher boiling impurities, in a column having a top condenser-reboiler, into nitrogen-richer vapor and oxygen-enriched liquid containing higher boiling impurities;

(B) passing oxygen-enriched liquid from the column to the top condenser-reboiler;

(C) passing oxygen-enriched liquid from the top condenser-reboiler through an adsorbent bed, transferring higher boiling impurities from the liquid to the adsorbent, and returning resulting cleaned liquid to the top condenser-reboiler; and (D) driving the liquid back to the top condenser-reboiler, at least in part, by combining the liquid with vapor to reduce the density of the stream passing back to the top condenser-reboiler.

2. The method of claim 1 wherein the column is the lower pressure column of a double column air separation method.

3. The method of claim 2 wherein vapor from the higher pressure column forms at least part of the density-reducing vapor of step (D).

4. The method of claim 1 wherein the column is the column of a single column air separation method.

5. The method of claim 1 wherein the column contains a second condenser-reboiler at the bottom of the column.

6. The method of claim 5 wherein vapor from the second condenser-reboiler at the bottom of the column forms at least part of the density-reducing vapor of step (D).

7. The method of claim 1 wherein the adsorbent bed comprises silica gel, alumina and/or molecular sieve.

8. The method of claim 1 wherein the oxygen-enriched liquid is passed from the top condenser-reboiler to the adsorbent bed, at least in part, by gravity.

9. The method of claim 1 wherein vapor is removed from the column and forms at least part of the density-reducing vapor of step (D).

10. The method of claim 1 wherein column feed vapor forms at least part of the density-reducing vapor of step (D).

11. The method of claim 1 wherein air forms at least part of the density-reducing vapor of step (D).

12. A method for cryogenic separation comprising:

(A) separating a feed comprising nitrogen, oxygen and higher boiling impurities, in a column having a top condenser-reboiler, into nitrogen-richer vapor and oxygen-enriched liquid containing higher boiling impurities;

(B) passing oxygen-enriched liquid from the column to the top condenser-reboiler;

(C) passing oxygen-enriched liquid from the top condenser-reboiler through an adsorbent bed, transferring higher boiling impurities from the liquid to the adsorbent, and returning resulting cleaned liquid to the top condenser-reboiler; and (D) driving the liquid back to the top condenser-reboiler, at least in part, by vaporizing some of this liquid to reduce the density of the stream passing back to the to condenser-reboiler.

13. The method of claim 12 wherein the partial vaporization of the oxygen-enriched liquid is achieved by reducing the pressure of the oxygen-enriched liquid.

* * * * *